US009495903B2

(12) United States Patent
Kwon et al.

(10) Patent No.: US 9,495,903 B2
(45) Date of Patent: Nov. 15, 2016

(54) DISPLAY DEVICE

(71) Applicant: Samsung Display Co., Ltd., Yongin (KR)

(72) Inventors: Tae Hoon Kwon, Yongin-si (KR); Kyoung Jin Park, Guri-si (KR); Min Woo Byun, Jeju-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 38 days.

(21) Appl. No.: 14/678,612

(22) Filed: Apr. 3, 2015

(65) Prior Publication Data

US 2016/0140896 A1 May 19, 2016

(30) Foreign Application Priority Data

Nov. 19, 2014 (KR) ..... 10-2014-0161787

(51) Int. Cl.
*G09G 3/30* (2006.01)
*G09G 3/32* (2016.01)

(52) U.S. Cl.
CPC .... *G09G 3/3225* (2013.01); *G09G 2320/0693* (2013.01); *G09G 2330/10* (2013.01); *G09G 2330/12* (2013.01)

(58) Field of Classification Search
None
See application file for complete search history.

(56) References Cited

U.S. PATENT DOCUMENTS

2011/0175800 A1* 7/2011 Mizumaki ..... G09G 3/006 345/87
2014/0176844 A1 6/2014 Yanagisawa

FOREIGN PATENT DOCUMENTS

JP 5513262 6/2014
KR 10-2009-0105027 10/2009
KR 10-2013-0136806 12/2013

* cited by examiner

*Primary Examiner* — Adam R Giesy
(74) *Attorney, Agent, or Firm* — H.C. Park & Associates, PLC

(57) ABSTRACT

A display device including a display area and a non-display area surrounding the display area. The non-display area includes a test data line (TDL) which receives a test data signal from an external source, a plurality of connection line units (CLUs) which connect the data lines and the TDL, and a dummy line unit which is formed in the non-display area. Each of the CLUs includes a test switch having an input terminal connected to the TDL, an output terminal connected to one of a plurality of data lines disposed in the display area, and a control terminal connected to a test switch control line which receives a test switch control signal from an external source. At least one of the CLUs includes a disconnection portion which interrupts the TDL, wherein both ends of the disconnection portion are connected to the dummy line unit by bypass connection lines, respectively.

16 Claims, 15 Drawing Sheets

DISPLAY DEVICE

CROSS-REFERENCE TO RELATED APPLICATION

This application claims priority from and the benefit of Korean Patent Application No. 10-2014-0161787, filed on Nov. 19, 2014, which is hereby incorporated by reference for all purposes as if fully set forth herein.

BACKGROUND

1. Field

Exemplary embodiments relate to a display device. More particularly, exemplary embodiments relate to a display device with an improved level of display quality with fewer numbers of defects.

2. Discussion of the Background

With the development of multimedia, the importance of display devices is increasing. Accordingly, various types of display devices, such as liquid crystal displays (LCDs) and organic electroluminescent display devices are being used.

In an LCD, an electric field is applied to a liquid crystal material having negative dielectric anisotropy between two substrates. By controlling the intensity of the electric field, the amount of light (from an external light source) transmitted through the substrates is adjusted, thereby obtaining a desired image signal.

Generally, an organic electroluminescent display device emits light by electrically exciting a fluorescent organic compound. The organic electroluminescent display device may display an image by driving a plurality of organic light-emitting diodes (OLEDs) arranged in a matrix using voltage programming or current programming. Methods of driving the organic electroluminescent display device include a passive matrix method or an active matrix method using thin-film transistors (TFTs). In the passive matrix method, anodes and cathodes are formed to be orthogonal to each other, and lines are selected to be driven. On the other hand, in the active matrix method, a TFT is connected to each indium tin oxide (ITO) pixel electrode and driven according to a voltage maintained by the capacitance of a capacitor connected to a gate of the TFT.

A defect detection process must be performed before an electronic device using a display device is finally produced. In the defect detection process, a plurality of pixels formed in the display device may be illuminated to determine whether the display device operates normally.

In the defect detection process performed by illuminating a plurality of pixels, a test voltage is generally applied to each pixel to identify whether there are defective pixels. However, while defective pixels can be detected, other defects, such as fractures and cracks existing in a region other than the region in which the pixels are formed, might not be detected. Even if the display device is determined to be non-defective in the pixel illumination test, other defects, such as fractures and cracks existing in the region other than the region in which the pixels are formed, can later increase in number, or moisture can penetrate into the display device through the fractures and cracks. In such cases, the operation or performance of the pixels may be adversely affected.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a display device in which defects existing in a non-display area can be detected.

Exemplary embodiments also provide a display device in which defects existing in a non-display area can be detected with improved detection capability.

Additional aspects will be set forth in the detailed description which follows, and, in part, will be apparent from the disclosure, or may be learned by practice of the inventive concept.

An exemplary embodiment of the present invention discloses a display device including a display area having a plurality of pixels formed at intersections of a plurality of data lines and a plurality of gate lines; a non-display area surrounding the display area, wherein the non-display area includes a test data line that receives a test data signal from an external source, a plurality of connection line units that connect the data lines and the test data line, and a dummy line unit which is formed in at least a region of the non-display area. Each of the connection line units includes a test switch having an input terminal connected to the test data line, an output terminal connected to one of the data lines, and a control terminal connected to a test switch control line that receives a test switch control signal from an external source. At least one of the connection line units includes a disconnection portion that interrupts the test data line, wherein both ends of the disconnection portion are connected to the dummy line unit by bypass connection lines, respectively.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
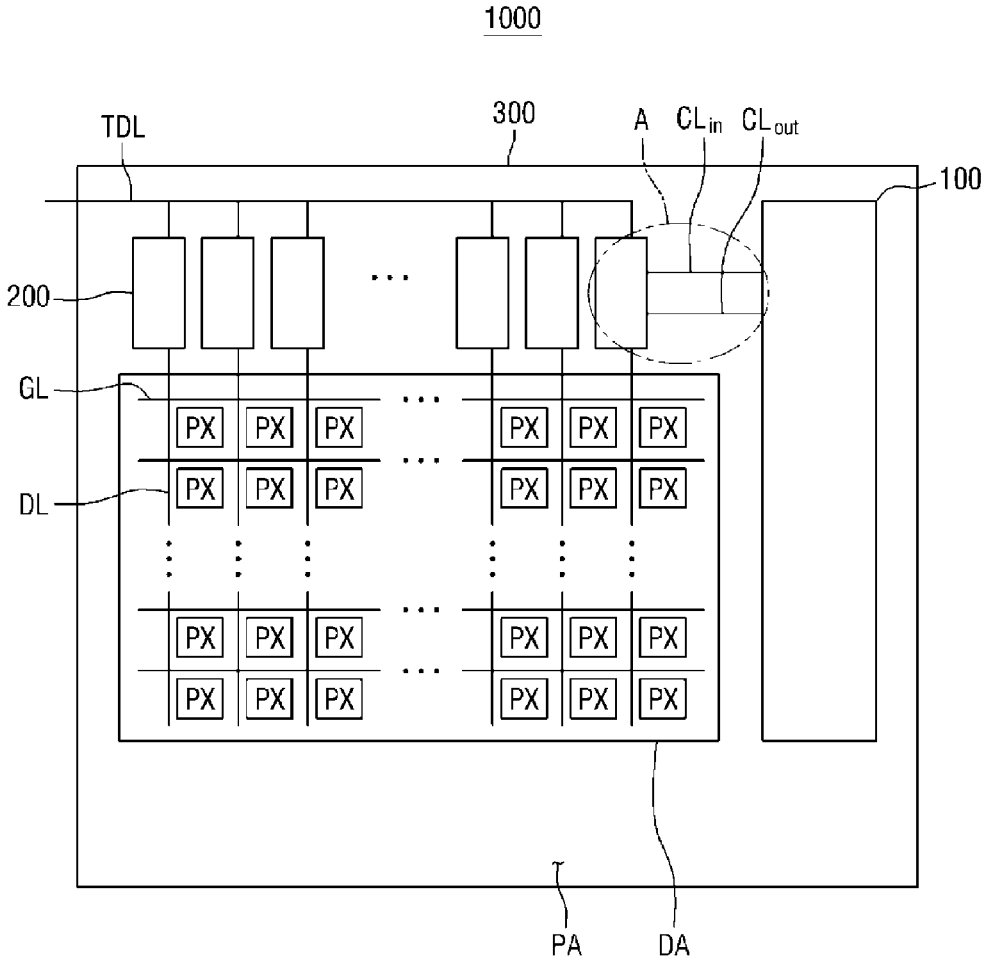
FIG. 1 is a schematic diagram of a display device according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a schematic diagram of a display device 1000 according to an exemplary embodiment of the present invention.

Referring to FIG. 1, the display device 1000 includes a substrate 300, a display area DA, and a non-display area PA.

The substrate 300 is a plate-shaped structure on which various elements and lines of the display device 1000 are mounted. The display area DA, in which a plurality of pixels PX for displaying colors are formed, and the non-display area PA, which is located outside the display area DA, may be defined in the substrate 300. Various elements and lines that constitute the display device 1000 may be mounted in multiple layers on the substrate 300.

The display area DA is where the pixels PX capable of displaying colors are arranged to display an image. In the display area DA, a plurality of data lines DL may be arranged in a first direction, and a plurality of gate lines GL may be arranged in a second direction intersecting the first direction. In addition, the display area DA may include the pixels PX defined at intersections of the data lines DL and the gate lines GL and connected to the data lines DL and the gate lines GL.

The non-display area PA is located outside the display area DA of the display device 1000 and surrounds the display area DA. The non-display area PA may include a test data line TDL, a plurality of connection line units 200, and a dummy line unit 100.

The test data line TDL may receive a test data signal TDS from an external source and provide the received test data signal TDS to the connection line units 200.

The test data signal TDS may be a signal that a data driver (not illustrated) provides to the test data line TDL. Although not illustrated in the drawing, the test data signal TDS may be generated by the data driver (not illustrated), which provides a voltage needed for each pixel PX to display an intended color during the operation of the display device 1000. However, the present invention is not limited thereto, and the test data signal TDS can also be generated by a test module (not illustrated) formed in the non-display area PA. Alternatively, the test data signal TDS may be generated by an external test device (not illustrated) and provided through a test line which is electrically connected to the external test device (not illustrated) by a pad (not illustrated).

In addition, the test data signal TDS may be a signal in the form of a pulse that swings between two specific voltage values. However, the present invention is not limited thereto. If each of the connection line units 200 further includes a switching element, the test data signal TDS may be a direct current (DC) signal having a specific voltage value. The waveform and voltage value of the test data signal TDS will be described in detail later with reference to FIG. 7.

The connection line units 200 may connect the test data line TDL and the data lines DL. Because the number of the data lines DL is greater than one, the number of the connection line units 200 may also be greater than one. Each of the connection line units 200 may include one conducting line extending from the test data line TDL to a data line DL. Each of the connection line units 200 may also include a switching element. In this case, the switching element will be described in detail later with reference to FIG. 5.

At least any one of the connection line units 200 may include a disconnection portion 210, which interrupts a line. The disconnection portion 210 will now be described in detail with reference to FIG. 2.

Figure 2:
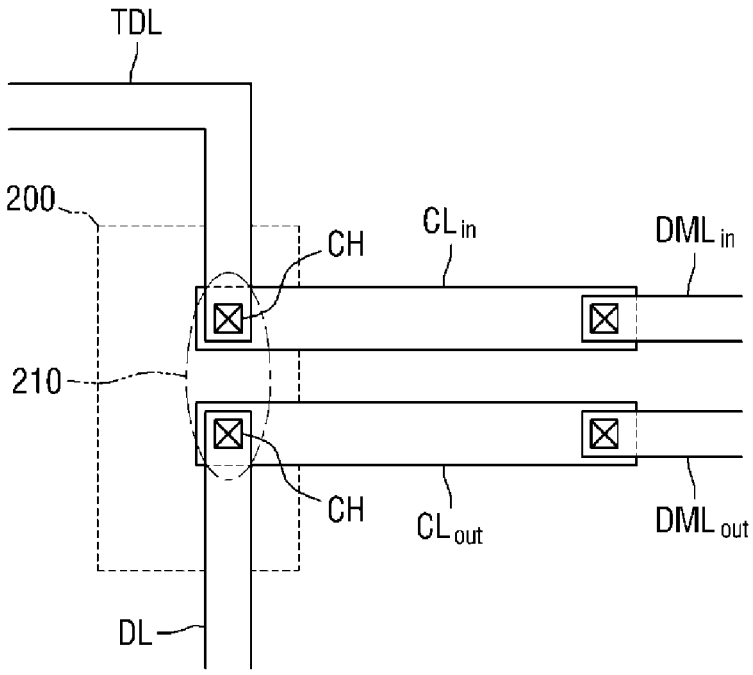
FIG. 2 is an enlarged plan view of a region 'A' of FIG. 1.

FIG. 2 is an enlarged plan view of a region 'A' of FIG. 1.

Referring to FIG. 2, the disconnection portion 210 is located in a connection line unit 200 disposed between the test data line TDL and a data line DL. Therefore, the test data line TDL and the data line DL may not physically be directly connected to each other. Instead, the test data line TDL and the data line DL may be indirectly connected to each other by bypass connection lines (CLin, Clout) connected to the disconnection portion 210 and the dummy line unit 100.

The bypass connection lines (CLin, Clout) may include an input bypass connection line CLin and an output bypass connection line Clout. The input bypass connection line CLin and the output bypass connection line CLin may electrically connect the connection line unit 200 and the dummy line unit 100.

More specifically, an end of the connection line unit 200 created by the disconnection portion 210 may be connected to an input terminal DMLin of the dummy line unit 100 by the input bypass connection line CLin, and the other end created by the disconnection portion 210 may be connected to an output terminal DMLout of the dummy line unit 100 by the output bypass connection line Clout. Therefore, if the disconnection portion 210 is included in the connection line unit 200, the test data signal TDS transmitted to the test data line TDL may be provided to the data line DL via the dummy line unit 100.

As described above, various lines and elements may be mounted in multiple layers on the substrate 300. The test data line TDL, the connection lines CLin and Clout, a dummy line, and the data lines DL may be formed on the same layer or different layers. If formed on different layers, the test data line TDL, the connection lines CLin and Clout, the dummy line, and the data lines DL may be connected to each other by a through hole CH that penetrates the different layers.

Again referring to FIG. 1, the non-display area PA may include the dummy line unit 100.

The dummy line unit 100 may include a line and an element which electrically connect the input terminal DMLin (see FIG. 5) of the dummy line unit 100 and the output terminal DMLout (see FIG. 5) of the dummy line unit 100. The line and the element included in the dummy line unit 100 will be described in detail later with reference to FIG. 8 through FIG. 15.

The dummy line unit 100 may receive the test data signal TDS from the input bypass connection line CLin and provide the test data signal TDS to the output bypass connection line Clout, as described above with reference to FIG. 2. Consequently, part of the test data signal TDS transmitted to the test data line TDL may be provided to pixels PX via the dummy line unit 100.

In addition, the test data signal TDS provided to the pixels PX via the dummy line unit 100 can be used to sense or detect defects existing in the non-display area PA. The defects, such as fractures or cracks can degrade the image display performance of the display area DA. If the defects, such as fractures or cracks, exist in a region where the dummy line unit 100 is formed, a resistance value of the line and the element included in the dummy line unit 100 may increase, or, even worse, the line and the element may separate from each other. In this case, a pixel PX receiving the test data signal TDS via the dummy line unit 100 may display an unintended color since a voltage of the test data signal TDS is lowered as the test data signal TDS passes through the dummy line unit 100 due to the increased resistance value of the dummy line unit 100. Therefore, if the pixel PX displays the unintended color, it can be determined that a defect exists in the dummy line unit 100. Types of the defects are not limited to fractures and cracks, and may include all types of physical defects that can degrade the image display performance of the display area DA.

Figure 3:
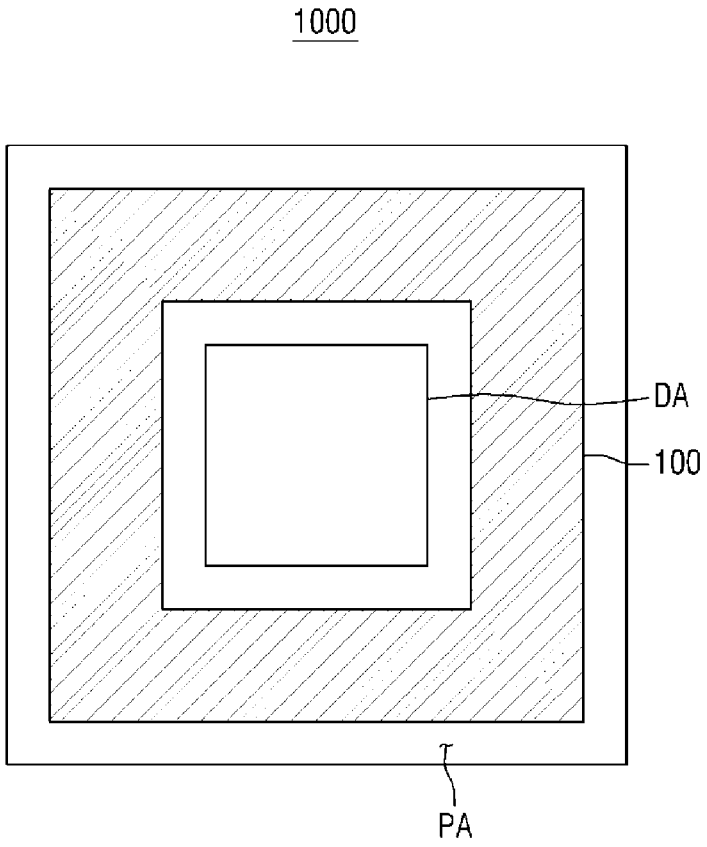
FIG. 3 is a plan view of the display device illustrated in FIG. 1.
Figure 4:
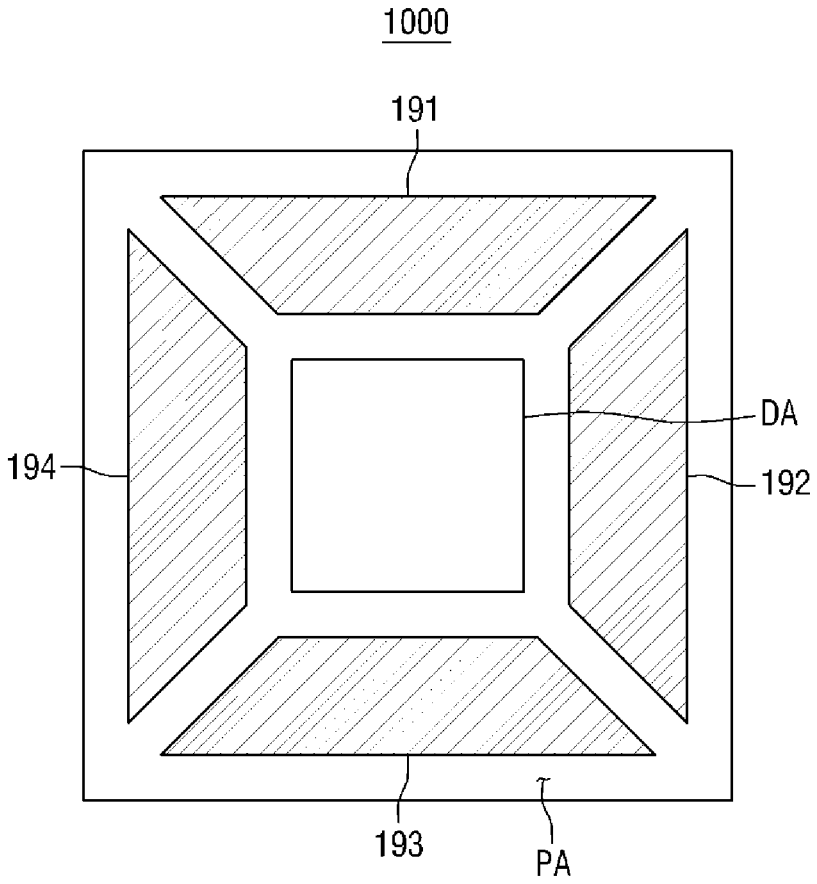
FIG. 4 is a plan view of a display device according to another exemplary embodiment of the present invention.

FIG. 3 is a plan view of the display device 1000 illustrated in FIG. 1. FIG. 4 is a plan view of a display device 1000 according to another exemplary embodiment of the present invention.

Referring to FIG. 3, the dummy line unit 100 may cover regions outside all edges of the display area DA. Accordingly, defects existing in the regions outside all edges of the display area DA can be detected. However, the present invention is not limited thereto, and the dummy line unit 100 can also be formed in a region outside a specific side of the display area DA or in a specific region of the non-display area PA, regardless of the sides of the display area DA. In addition, a region in which the dummy line unit 100 is formed may not necessarily be quadrilateral, but may have various other shapes, such as a circle.

Referring to FIG. 4, a plurality of dummy line units 100 may be formed. In FIG. 4, first through fourth dummy line units 191 through 194 are illustrated. However, the present invention is not limited thereto, and more dummy line units 100 can be formed in a non-display area PA.

If the dummy line units 100 are placed in a plurality of regions into which the non-display area PA is divided, as illustrated in FIG. 4, the position of a detected defect can be identified. In particular, as the number of the dummy line units 100 increases, the position of the detected defect can be identified more with more precision. In addition, the dummy line units 100 need not necessarily be placed symmetrically in the manner illustrated in FIG. 4. The first dummy line unit 191 can be formed to occupy a wider region of the non-display area PA than the second-through-fourth dummy line units 191 through 194. In addition, the first-through-fourth dummy line units 191 through 194 can be formed to have different shapes.

The sizes of dummy line unit 100 and the first-through-fourth dummy line units 191 through 194 illustrated in FIGS. 3 and 4 are exaggerated to greater than actual size for better understanding of the present invention. Therefore, the dummy line unit 100 and the first-through-fourth dummy line units 191 through 194 illustrated in FIGS. 3 and 4 may actually occupy a smaller region of the substrate 300, and the display area DA may occupy a larger region of the substrate 300.

Figure 5:
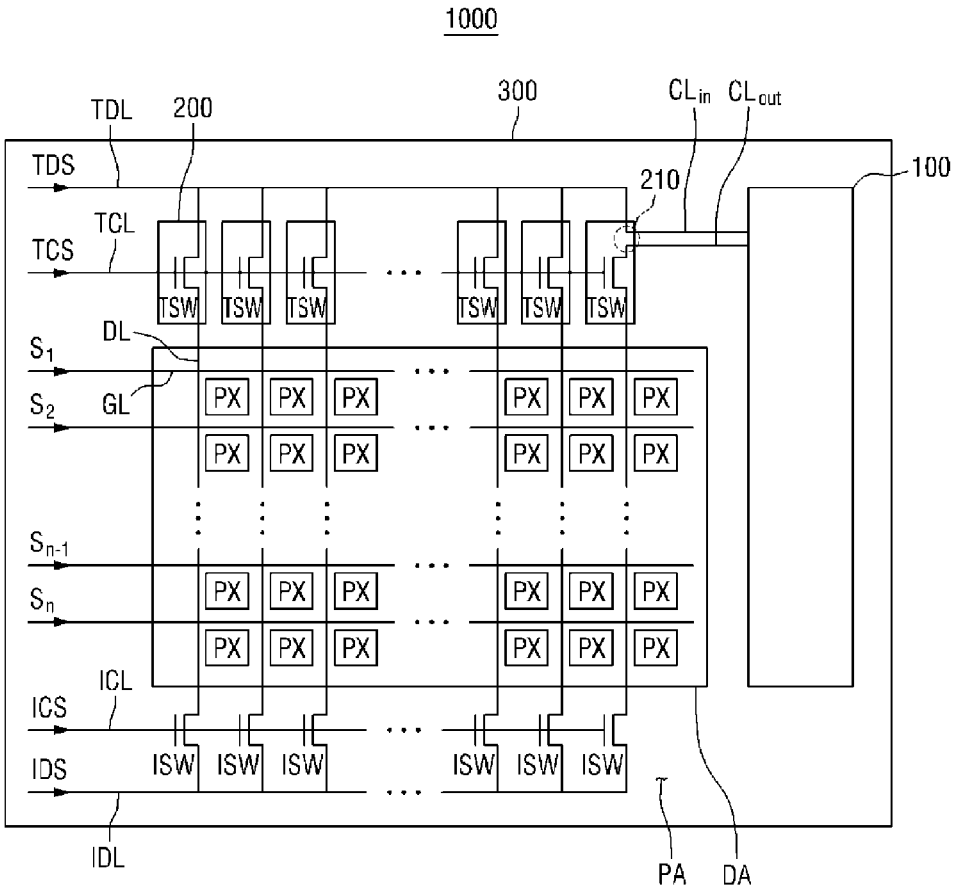
FIG. 5 is a schematic diagram of a display device according to another exemplary embodiment of the present invention.

FIG. 5 is a schematic diagram of a display device 1000 according to another exemplary embodiment of the present invention.

For simplicity, a description of elements substantially identical to those of FIG. 1 will be omitted, and the current exemplary embodiment will hereinafter be described, focusing mainly on differences with the pervious embodiment of FIG. 1.

Referring to FIG. 5, unlike in FIG. 1, each of a plurality of connection line units 200 may further include a test switch TSW.

The test switch TSW may have input and output terminals respectively connected to both ends of each connection line unit 200, which are formed by cutting a line of the connection line unit 200 and a control terminal connected to a test switch control line TCL, which receives a test switch control signal TCS from an external source. As illustrated in FIG. 5, the test switch TSW may be a transistor having a source terminal which corresponds to the input terminal, a drain terminal which corresponds to the output terminal, and a gate terminal which corresponds to the control terminal.

In addition, the test switch TSW may be a p-channel metal oxide semiconductor (PMOS) transistor or an n-channel metal oxide semiconductor (NMOS) transistor. If the test switch TSW is the NMOS transistor, a voltage value of the gate terminal may be higher when the test switch TSW is turned on than when the test switch TSW is turned off. If the test switch TSW is the PMOS transistor, the voltage value of the gate terminal may be lower when the test switch TSW is turned on than when the test switch TSW is turned off. However, the present invention is not limited thereto, and other types of electronic elements can also be used as the test switch TSW.

The test switch TSW may determine whether to provide a test data signal TDS received from a test data line TDL to a corresponding data line DL according to a voltage level of the test switch control signal TCS. When the test switch TSW is turned on, the test data signal TDS may be provided to the corresponding data line DL. Accordingly, the test data signal TDS may be provided to pixels PX via the corresponding data line DL. When the test switch TSW is turned off, the test data signal TDS may not be provided to the corresponding data line DL. Accordingly, the pixels PX are then not provided with the test data signal TDS.

The test switch control signal TCS may be generated by a data driver (not illustrated) which provides a voltage needed for each pixel PX to display an intended color during the operation of the display device 1000. However, the present invention is not limited thereto, and the test switch control signal TCS can also be generated by a test module (not illustrated) formed in a non-display area PA. Alternatively, the test switch control signal TCS may be generated by an external test device (not illustrated) and provided through a test line which is electrically connected to the external test device (not illustrated) by a pad (not illustrated). The waveform of the test switch control signal TCS will be described in detail later with reference to FIG. 7.

As described above with reference to FIG. 1, the test data signal TDS may be a DC signal having a specific voltage value. In this case, the specific voltage value of the test data signal TDS may be a voltage value that causes each pixel PX to emit light with the highest intensity or the lowest intensity.

In addition, if the test data signal TDS is a DC signal having a specific voltage value, a signal in the form of a pulse may be provided to each data line DL by the repeated turn-on and turn-off of the test switch TSW.

In a connection line unit 200 including both a disconnection portion 210 and the test switch TSW, the disconnection portion 210 may be formed on the side of the input terminal of the test switch TSW. Specifically, the test data line TDL and a dummy line unit 100 may be used to detect defects existing in the display device 1000. This is because the test data line TDL and the dummy line unit 100 are disconnected from a corresponding data line DL, and do not perform their functions after the process of detecting all defects in the display device 1000. To this end, the disconnection portion 210 may be formed on the side of the input terminal of the test switch TSW such that the test data line TDL and the dummy line unit 100 can be disconnected from the data line DL when the test switch TSW is turned off.

Referring to FIG. 5, unlike in FIG. 1, the non-display area PA may further include a plurality of initialization switches ISW. Each of the initialization switches ISW may have an input terminal connected to an initialization data line IDL that receives an initialization data signal IDS from an external source, an output terminal that is connected to a data line DL, and a control terminal connected to an initialization switch control line ICL that receives an initialization switch control signal ICS. As illustrated in FIG. 5, each of the initialization switches ISW may be a transistor having a source terminal that corresponds to the input terminal, a drain terminal that corresponds to the output terminal, and a gate terminal that corresponds to the control terminal.

In addition, each of the initialization switches ISW may be a PMOS transistor or an NMOS transistor. If each of the initialization switches ISW is the NMOS transistor, a voltage value of the gate terminal may be higher when the initialization switch ISW is turned on than when the initialization switch ISW is turned off. If each of the initialization switches ISW is the PMOS transistor, the voltage value of the gate terminal may be lower when the initialization switch ISW is turned on than when the initialization switch ISW is turned off. However, the present invention is not limited thereto, and other types of electronic elements can also be used as each of the initialization switches ISW.

Each of the initialization switches ISW may determine whether to provide the initialization data signal IDS received from the initialization data line IDL to a corresponding data line DL according to a voltage level of the initialization switch control signal ICS. When each of the initialization switches ISW is turned on, the initialization data signal IDS may be provided to the corresponding data line DL. Accordingly, the initialization data signal IDS may be provided to pixels PX via the corresponding data line DL. When each of the initialization switches ISW is turned off, the initialization data signal IDS may not be provided to the corresponding data line DL. Accordingly, the pixels PX are then not provided with the initialization data signal IDS.

The initialization switch control signal ICS may be generated by the data driver (not illustrated) which provides a voltage needed for each pixel PX to display an intended color during the operation of the display device 1000. However, the present invention is not limited thereto, and the initialization switch control signal ICS can also be generated by the test module (not illustrated) formed in the non-display area PA. Alternatively, the initialization switch control signal ICS may be generated by the external test device (not illustrated) and provided through the initialization switch control line ICL which is electrically connected to the external test device (not illustrated) by a pad (not illustrated). The waveform of the initialization switch control signal ICS will be described in detail later with reference to FIG. 7.

The initialization data signal IDS may be a DC signal having a specific voltage value. Specifically, the specific voltage value of the initialization data signal IDS may be a voltage value that causes each pixel PX to emit light with the highest intensity or the lowest intensity. In this case, the voltage value of the initialization data signal IDS may be opposite to the voltage value of the test data signal TDS. This is because each pixel PX emits light in response to the test data signal TDS and the initialization data signal IDS alternately transmitted thereto. This will be described in detail later with reference to FIG. 7.

In addition, if the test data signal TDS is a DC signal having a specific voltage value, a signal in the form of a pulse may be provided to each data line DL by the repeated turn-on and turn-off of a corresponding test switch TSW.

Figure 6:
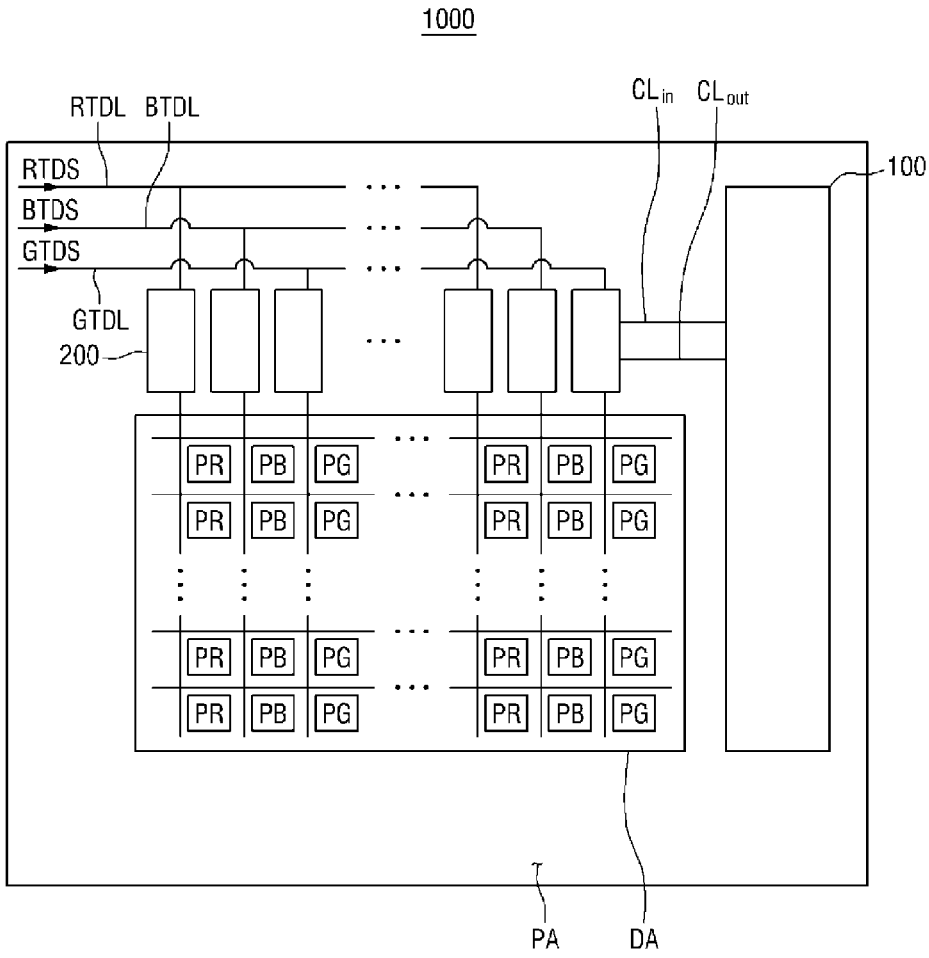
FIG. 6 is a schematic diagram of a display device according to another exemplary embodiment of the present invention.

FIG. 6 is a schematic diagram of a display device 1000 according to another exemplary embodiment of the present invention.

For simplicity, a description of elements substantially identical to those of FIG. 1 will be omitted, and the current exemplary embodiment will hereinafter be described, focusing mainly on differences with the exemplary embodiment of FIG. 1.

Referring to FIG. 6, unlike in FIG. 1, a display area DA may include red pixels PR which display a red color, blue pixels PB which display a blue color, and green pixels PG which display a green color. One red pixel PR, one blue pixel PB, and one green pixel PG may form one pixel unit (not illustrated). The pixel unit (not illustrated) may express various colors by adjusting the emission intensity of each of the red pixel PR, the blue pixel PB, and the green pixel PG.

In addition, referring to FIG. 6, a non-display area PA may include a red test data line RTDL connected to columns of the red pixels PR, a blue test data line BTDL connected to columns of the blue pixels PB, and a green test data line GTDL connected to columns of the green pixels PG, instead of the test data line TDL illustrated in FIG. 1. In addition, a red test data signal RTDS may be transmitted to the red test data line RTDL, a blue test data signal BTDS may be transmitted to the blue test data line BTDL, and a green test data signal GTDS may be transmitted to the green test data line GTDL. This is because the red, blue, and green pixels PR, PB and PG may require signals having different voltage values to display desired colors.

Referring to FIGS. 2 and 6, a connection line unit 200 including a disconnection portion 210 may be connected to the green pixels PG. Thus, whether defects exist in the display device 1000 can be identified more clearly. Specifically, when PMOS transistors are used in the display device 1000, if a test data signal TDS having a highest voltage value is transmitted to pixels PX, the pixels PX may display black. On the other hand, if the test data signal TDS having a lowest voltage value is transmitted to the pixels PX, the pixels PX may display white. Here, if the connection line unit 200 connected to the green pixels PG includes the disconnection portion 210, the test data signal TDS may be transmitted to the green pixels PG via a dummy line unit 100. Therefore, if a defect exists in the dummy line unit 100, an image with a green line in the black background may be displayed, which is more visible than other combinations of colors.

Figure 7:
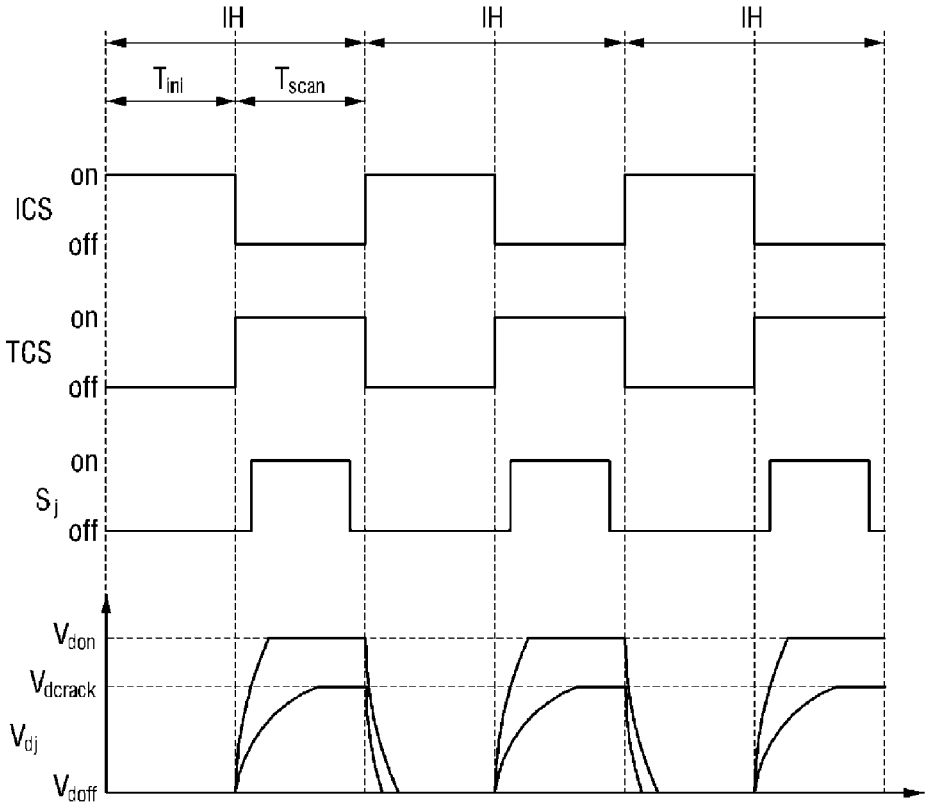
FIG. 7 is a timing diagram of various signals and a graph of voltages provided to data lines according to an exemplary embodiment of the present invention.

FIG. 7 is a timing diagram of various signals and a graph of voltages provided to a light-emitting element in each pixel PX according to an exemplary embodiment of the present invention.

In FIG. 7, the initialization switch control signal ICS, the test switch control signal TCS, a $j^{th}$ scan signal Sj transmitted to a $j^{th}$ gate line, and a voltage Vdj applied to a data line DL are illustrated.

Scan signals S1 through Sn may be transmitted from an external source to the gate lines GL. Each of the scan signals S1 through Sn may determine whether a voltage provided to a data line DL can be applied to elements (not illustrated) of a pixel PX. When each of the scan signals S1 through Sn has a voltage value of an "off" level, the voltage provided to the data line DL may not be applied to the elements (not illustrated) of the pixel PX. Accordingly, the pixel PX does not then emit light. When each of the scan signals S1 through Sn has a voltage value of an "on" level, the voltage provided to the data line DL may be applied to the elements (not illustrated) of the pixel PX. Accordingly, the pixel PX may emit light. The scan signals S1 through Sn may be generated by the external source and provided through the gate lines GL. However, the present invention is not limited thereto, and the scan signals S1 through Sn can also be provided by a scan signal generating module (not illustrated) formed in the non-display area PA.

The signals illustrated in FIG. 7 may operate in each emission period 1H which is a minimum period needed to control a pixel PX to display a color. Each emission period 1H may be divided into an initialization time Tini and a scan time Tscan.

During the initialization time Tini, the test switch control signal TCS may be maintained at the "off" level to turn off a test switch TSW. Therefore, the test data signal TDS is not provided to a data line DL.

In addition, during the initialization time Tini, the initialization switch control signal ICS may be maintained at the "on" level to turn on an initialization switch ISW. Therefore, the initialization data signal IDS may be provided to the data line DL, and the data line DL may be maintained at a voltage value of the initialization data signal IDS.

In addition, during the initialization time Tini, the $j^{th}$ scan signal Sj may be maintained at the "off" level to control a pixel PX to not emit light. Therefore, the voltage Vdj applied to the data line DL may be maintained at a normal "off" voltage Vdoff.

During the scan time Tscan following the initialization time Tini, the initialization switch control signal ICS may be maintained at the "off" level to turn on the initialization switch ISW. Therefore, the initialization data signal IDS may not be provided to the data line DL.

In addition, during the scan time Tscan, the test switch control signal TCS may be maintained at the "on" level to turn on the test switch TSW. Therefore, the test data signal TDS may be provided to the data line DL, and the data line DL may be maintained at a voltage value of the test data signal TDS.

In addition, during the scan time Tscan, the $j^{th}$ scan signal Sj may be maintained at the "on" level to control the pixel PX to emit light. Therefore, the voltage of the data line DL may be applied to the pixel PX.

In a case where the test data signal TDS is transmitted to the data line DL not via the dummy line unit 100 or a case where no defect exists even if the test data signal TDS is transmitted to the data line DL via the dummy line unit 100, a normal emission voltage Vdon may be applied to the data line DL. However, if the test data signal TDS is transmitted to the data line DL via the dummy line unit 100 which has a defect, a defective emission voltage Vdcrack may be applied to the data line DL. This is because a defect in the dummy line unit 100 increases a resistance value Rcrack of the dummy line unit 100, causing an unnecessary loss of voltage. In addition, it may take a longer time to reach the defective emission voltage Vd.crack than to reach the normal emission voltage Vd.on.

Therefore, a pixel PX receiving the test data signal TDS via the defective dummy line unit 100 may display a different color from a pixel PX receiving the test data signal TDS not via the defective dummy line unit 100. In this regard, a defect in the non-display area PA of the display device 1000 can be detected based on the color displayed by the pixel PX which receives the test data signal TDS via the defective dummy line unit 100.

Figure 8:
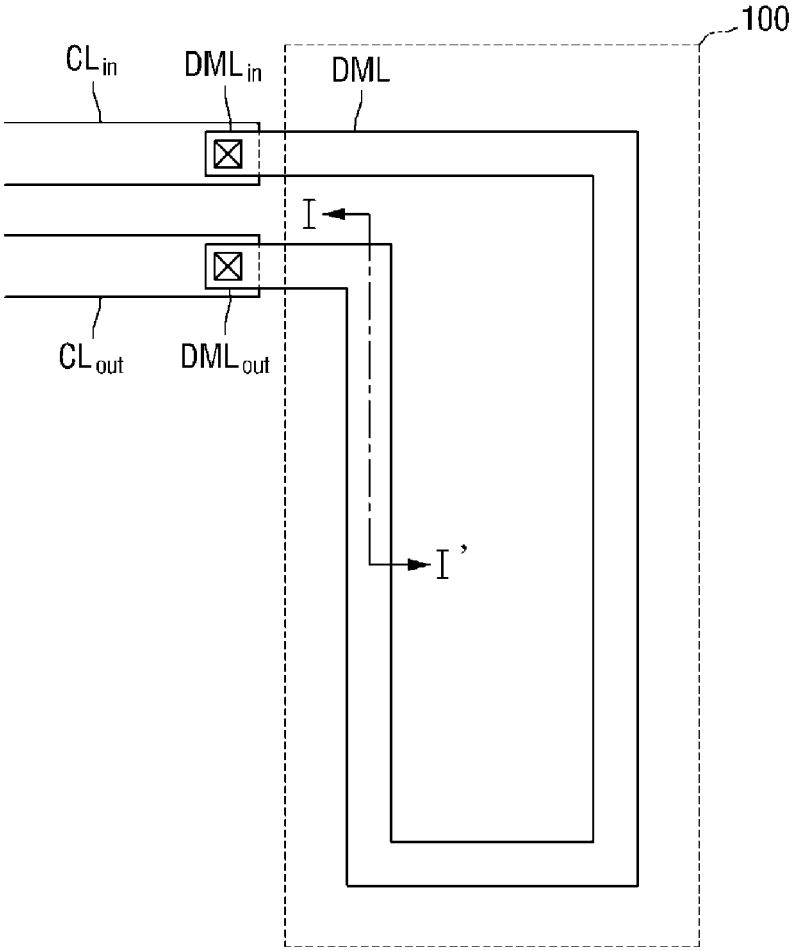
FIG. 8 is a plan view of a dummy line unit according to exemplary embodiments of the present invention.

FIG. 8 is a plan view of a dummy line unit 100 according to various exemplary embodiments of the present invention.

Referring to FIG. 8, a dummy line DML may be formed in the dummy line unit 100 along a region in which the dummy line unit 100 is formed. The dummy line unit 100 may have input and output terminals DMLin and DMLout respectively connected to bypass connection lines CLin and CLout so as to receive and output a test data signal TDS.

The dummy line DML illustrated in FIG. 8 is shaped in a straight line. However, the shape of the dummy line DML is not limited to the straight line, and the dummy line DML can have various shapes, such as curve or a zigzag shape. In addition, in FIG. 8, the input and output terminals DMLin and DMLout of the dummy line unit 100 and the bypass connection lines CLin and CLout are formed on different layers and connected by contact holes CH which penetrate the different layers. However, the bypass connection lines CLin and CLout and the input and output terminals DMLin and DMLout of the dummy line unit 100 can also be formed on the same layer and connected without the contact holes CH.

Figure 9:
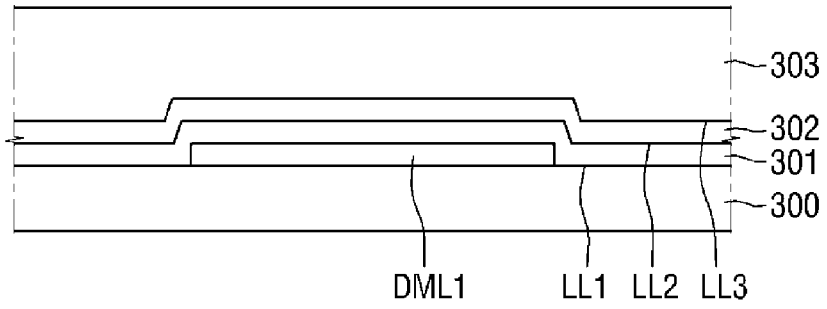
FIG. 9 is a cross-sectional view of the dummy line unit taken along the line I-I' of FIG. 8 according to an exemplary embodiment of the present invention.
Figure 10:
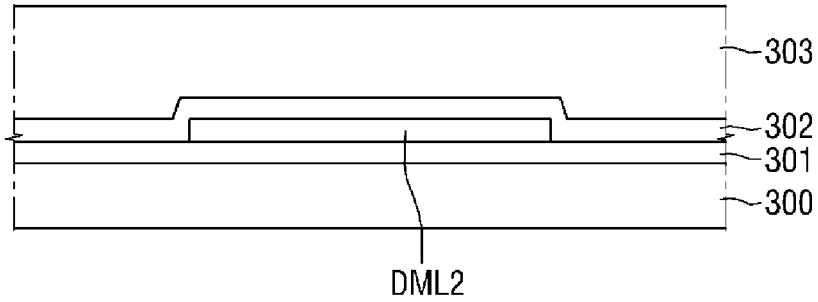
FIG. 10 is a cross-sectional view of the dummy line unit taken along the line I-I' of FIG. 8 according to another exemplary embodiment of the present invention.
Figure 11:
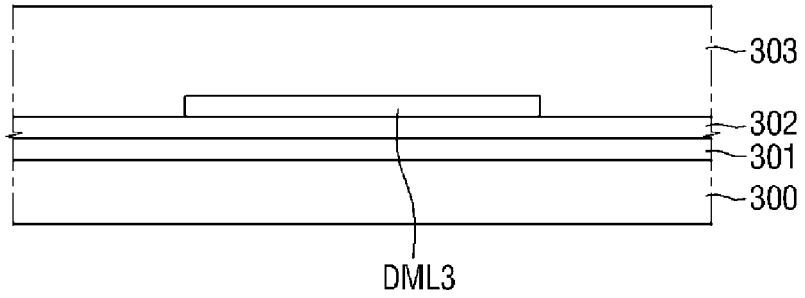
FIG. 11 is a cross-sectional view of the dummy line unit taken along the line I-I's of FIG. 8 according to another exemplary embodiment of the present invention.

FIG. 9 is a cross-sectional view of the dummy line unit 100 taken along the line I-I' of FIG. 8 according to an exemplary embodiment of the present invention. FIGS. 10 and 11 are cross-sectional views of the dummy line unit 100 taken along the line I-I' of FIG. 8 according to another exemplary embodiment of the present invention.

Referring to FIGS. 9 through 11, the dummy line unit 100 according to the current exemplary embodiment of the present invention may be formed on a substrate 300.

A first line layer LL1 may be defined on the substrate 300, a second line layer LL2 may be defined on the first line layer LL1 with a first insulating layer 301 interposed therebetween, and a third line layer LL3 may be defined on the second line layer LL2 with a second insulating layer 302 interposed therebetween. In addition, a third insulating layer 303 may be formed on the third line layer LL3. However, the present invention is not limited thereto, and another layer for forming lines and electronic elements can further be formed between the first through third line layers LL1 through LL3.

Various lines and elements that constitute a display device 1000 may be formed on the first line layer LL1, the second line layer LL2, and the third line layer LL3. For example, gate lines GL may be formed on the second line layer LL2, and data lines DL may be formed on the third line layer LL3. In addition, a transistor (not illustrated) may be formed by forming a channel region, a gate terminal, and source and drain terminals on each of the first through third line layers LL1 through LL3. However, the present invention is not limited thereto, and other various electronic elements can also be formed.

In addition, when various lines and elements of the display device 1000 are formed on the first through third line layers LL1 through LL3, a region of each of the first through third line layers LL1 through LL3 excluding a region in which the various lines and elements are formed may be filled with one of the first through third insulating layers 301 through 303 located on the first through third line layers LL1 through LL3, respectively. That is, any region of each of the first through third line layers LL1 through LL3 in which lines, etc. are not formed may not be left as an empty space.

Referring to FIG. 9, a first dummy line DML1 covered by the first insulating layer 301 may be formed on the first wring layer LL1. Referring to FIG. 10, a second dummy line DML2 covered by the second insulating layer 302 may be formed on the second line layer LL2. Referring to FIG. 11, a third dummy line DML3 covered by the third insulating layer 303 may be formed on the third line layer LL3.

The first through third dummy lines DML1 through DML3 may be formed at the same time as when other lines of the display device 1000 are formed on the first through third line layers LL1 through LL3 and may be made of the same material as these lines.

Figure 12:
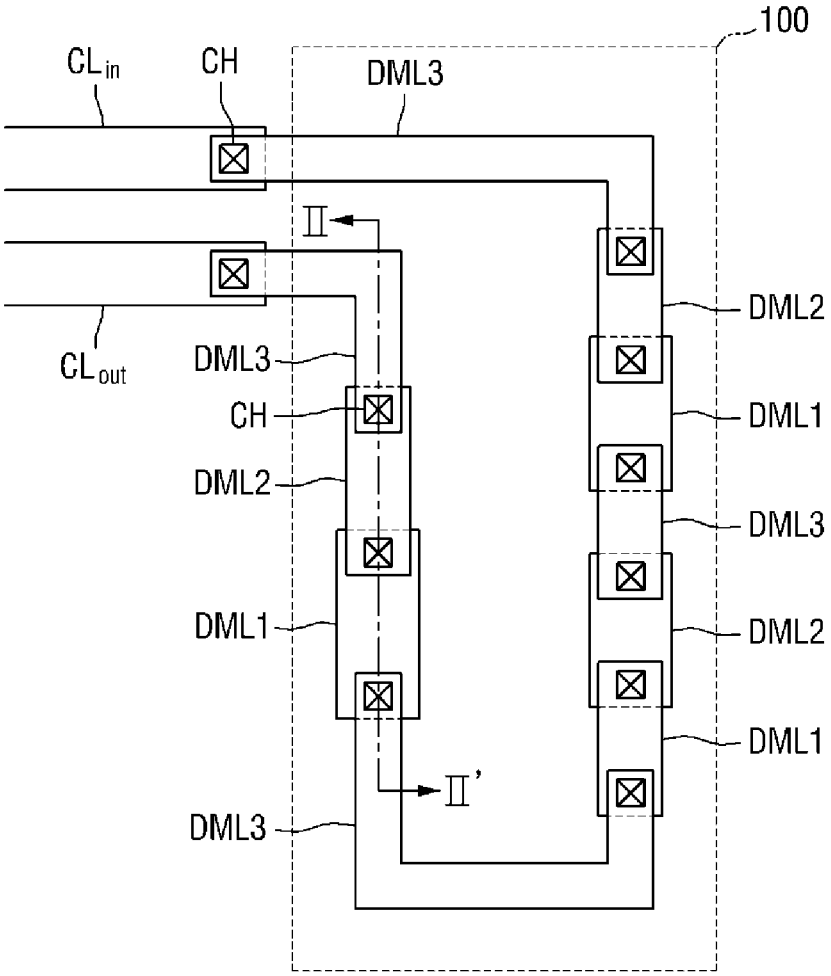
FIG. 12 is a plan view of a dummy line unit according to another exemplary embodiment of the present invention.

FIG. 12 is a plan view of a dummy line unit 100 according to another exemplary embodiment of the present invention.

FIG. 12 is identical to FIG. 8 except for the differences described below, and a description of other elements will be omitted.

Referring to FIG. 12, unlike the dummy line DML of FIG. 8, a plurality of first dummy lines DML1, a plurality of second dummy lines DML2, and a plurality of third dummy lines DML3 are formed and connected by contact holes CH which are located between layers to be connected and penetrate the layers.

If lines are electrically connected by a contact hole CH which penetrates each line layer or insulating layer, when defects, such as fractures or cracks, occur in the vicinity of a region in which the contact hole CH is formed, a resistance value Rcrack of the dummy line unit 100 may be increased by the presence of the defects. Here, the increase in the resistance value Rcrack of the dummy line unit 100 due to the defects may be greater than when the contact hole CH does not exist. Because the greater resistance value Rcrack can have a greater effect on the color display of pixels PX connected to the dummy line unit 100, detection capability can be improved.

Figure 13:
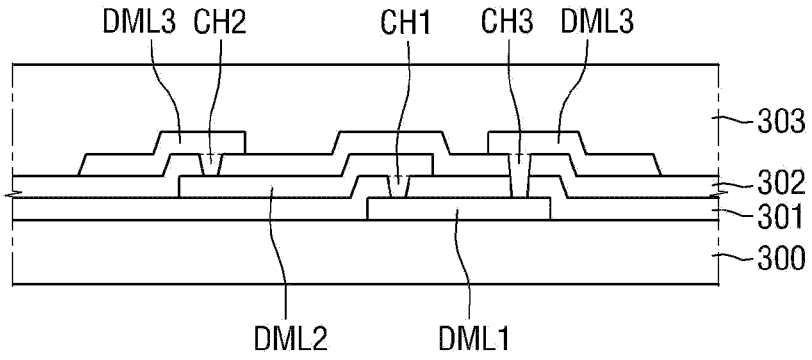
FIG. 13 is a cross-sectional view of the dummy line unit taken along the line II-IF of FIG. 12.

FIG. 13 is a cross-sectional view of the dummy line unit 100 taken along the line II-II' of FIG. 12 according to an exemplary embodiment of the present invention.

Referring to FIG. 13, the first and second dummy lines DML1 and DML2 may be connected by a contact hole CH1 that penetrates a first insulating layer 301, the second and third dummy lines DML2 and DML3 may be connected by a contact hole CH2 that penetrates a second insulating layer 302, and the third and first dummy lines DML3 and DML1 may be connected by a contact hole CH3 that penetrates both the first insulating layer 301 and the second insulating layer 302. However, the present invention is not limited to the above structure. If another layer is further formed between each of first through third line layers LL1 through LL3 and each of the first through third insulating layers 301 through 303, lines located on different layers may be connected by an additional contact hole that penetrates the different layers.

Figure 14:
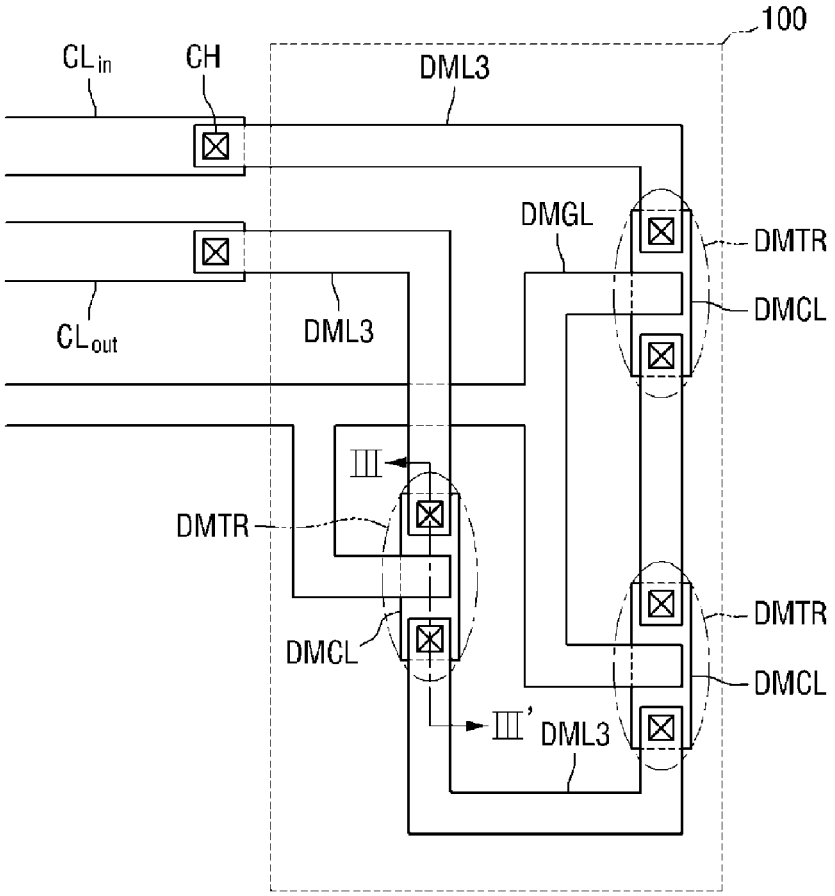
FIG. 14 is a plan view of a dummy line unit according to another exemplary embodiment of the present invention.

FIG. 14 is a plan view of a dummy line unit 100 according to another exemplary embodiment of the present invention.

FIG. 14 is identical to FIG. 8 except for the differences described below, and a description of other elements will be omitted.

Referring to FIG. 14, while the dummy line unit 100 of FIG. 8 includes only the dummy line DML formed on one layer, the dummy line unit 100 of FIG. 14 may include a plurality of dummy switches DMTR, each being a transistor having a third dummy line DML3 as a source terminal and a drain terminal, a dummy channel line DMCL formed on a first line layer LL1 as a channel region, and a dummy gate line DMGL formed on a second line layer LL2 as a gate terminal.

A dummy switch control signal (not illustrated) which determines whether to turn on or off each of the dummy switches DMTR may be transmitted from an external source to the dummy gate line DMGL. In addition, the dummy switch control signal (not illustrated) may be a signal always having a voltage of an on level. Specifically, when a test data signal TDS provided to the dummy line unit 100 is output normally from the dummy line unit 100, it can be determined that the dummy line unit 100 is not defective. To this end, each of the dummy switches DMTR should always be kept turned on to allow the test data signal TDS to pass therethrough. Only then can it be determined whether the dummy line unit 100 is defective, and this is why the dummy switch control signal is a signal always having a voltage of the on level.

The dummy switch control signal (not illustrated) may be generated by a data driver (not illustrated) which provides a voltage needed for each pixel PX to display an intended color during the operation of a display device 1000. However, the present invention is not limited thereto, and the dummy switch control signal can also be generated by a test module (not illustrated) formed in a non-display area PA. Alternatively, the dummy switch control signal may be generated by an external test device (not illustrated) and provided through the dummy gate line DMGL which is electrically connected to the external test device (not illustrated) by a pad (not illustrated).

In addition, the dummy switches DMTR are not limited to the transistors illustrated in FIG. 14, and other known electronic elements capable of functioning as switches formed on a substrate 300 can also be used.

If the dummy switches DMTR are formed in the dummy line unit 100, when a defect such as fractures or cracks occurs in the vicinity of a region in which each of the dummy switches DMTR is formed, a resistance value Rcrack of the dummy line unit 100 may be increased by the defect. Here, the increase in the resistance value Rcrack of the dummy line unit 100 as a result of the defect may be greater than when the dummy switches DMTR do not exist. Because the greater resistance value Rcrack can have a greater effect on the color display of pixels PX connected to the dummy line unit 100, detection capability can be improved.

Figure 15:
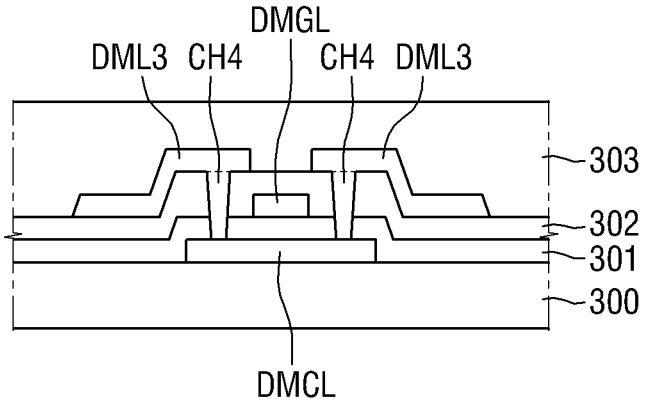
FIG. 15 is a cross-sectional view of the dummy line unit taken along the line III-III' of FIG. 14.

FIG. 15 is a cross-sectional view of the dummy line unit 100 taken along the line III-III' of FIG. 14 according to an exemplary embodiment of the present invention.

Referring to FIG. 15, the dummy channel line DMCL may be formed on the first line layer LL1 and covered by a first insulating layer 301.

In addition, the dummy gate line DMGL may be formed on the second line layer LL2, located on the first insulating layer 301, and covered by a second insulating layer 302. Therefore, the dummy channel line DMCL and the dummy gate line DMGL may be electrically insulated from each other.

Here, a portion of the dummy channel line DMCL that is overlapped by the dummy gate line DMGL may not be doped, and both sides of the portion may be doped with impurities. As a result of this structure, a signal provided to the dummy channel line DMCL may be passed or blocked according to a voltage value of a signal provided to the dummy gate line DMGL.

The third dummy line DML3 may be formed on a third line layer LL3, located on the second insulating layer 302, and covered by a third insulating layer 303. Unlike the dummy gate line DMGL, the third dummy line DML3 may be connected to the dummy channel line DMCL by a contact hole CH4 which penetrates the first insulating layer 301 and the second insulating layer 302. In addition, a plurality of the third dummy lines DML3 may be connected to the dummy channel line DMCL through a plurality of contact holes CH4, and the third dummy lines DML3 may include a third dummy line DML3 functioning as a source terminal and a third dummy line DML3 functioning as a drain terminal.

Each of the dummy switches DMTR is not limited to the transistor structured as in FIG. 15. Each of the dummy switches DMTR can also be formed as a transistor having a different structure. Alternatively, each of the dummy switches DMTR can have a structure of any known electronic element having a switching function.

The line structure illustrated in FIG. 13 can be formed at the same time as the structure of the dummy switch DMTR illustrated in FIG. 15.

Exemplary embodiments of the present invention make it possible to detect defects existing in a non-display area of a display device.

Further, exemplary embodiments may make it possible to improve the capability to detect the defects existing in the non-display area of the display device.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display device comprising:

a display area comprising a plurality of pixels formed at intersections of a plurality of data lines and a plurality of gate lines;

a non-display area surrounding the display area, wherein:

the non-display area comprises:

a test data line configured to receive a test data signal from an external source;

a plurality of connection line units connecting the data lines and the test data line; and a dummy line unit formed in at least a region of the non-display area;

each of the connection line units comprises:

a test switch comprising an input terminal connected to the test data line; an output terminal connected to one of the data lines; and a control terminal connected to a test switch control line and configured to receive a test switch control signal from an external source;

at least one of the connection line units comprises a disconnection portion configured to interrupt the test data line; and both ends of the disconnection portion are connected to the dummy line unit by bypass connection lines, respectively.

2. The display device of claim 1, further comprising a substrate in which the display area and the non-display area are defined, wherein:

the substrate comprises a first line layer, a second line layer, and a third line layer; and the first line layer is disposed on the substrate, the second line layer is disposed on the first line layer, and the third line layer is disposed on the second line layer.

3. The display device of claim 2, wherein the first line layer and the second line layer are separated by a first insulating layer interposed therebetween, and the second line layer and the third line layer are separated by a second insulating layer interposed therebetween.

4. The display device of claim 3, wherein the dummy line unit comprises at least one of a first dummy line disposed on the first line layer, a second dummy line disposed on the second line layer, and a third dummy line disposed on the third line layer.

5. The display device of claim 4, wherein the first dummy line and the second dummy line are connected by a contact hole which penetrates the first insulating layer, the second dummy line and the third dummy line are connected by a contact hole which penetrates the second insulating layer, and the first dummy line and the third dummy line are connected by a contact hole which penetrates both the first insulating layer and the second insulating layer.

6. The display device of claim 5, further comprising a plurality of each of the first, second, and third dummy lines, and a plurality of the contact holes.

7. The display device of claim 4, wherein the dummy line unit comprises a dummy switch comprises an input terminal connected to at least one of the first, second, and third line layers, an output terminal connected to at least one of the first, second, and third line layers, and a control terminal connected to a dummy switch control line configured to receive a dummy switch control signal from an external source.

8. The display device of claim 7, wherein the dummy switch comprises a transistor comprising an input terminal corresponding to a source electrode, an output terminal corresponding to a drain electrode, and a control terminal corresponding to a gate electrode.

9. The display device of claim 8, wherein the dummy switch comprises a channel formed on the first line layer, a gate electrode formed on the second line layer, and source and drain electrodes formed on the third line layer.

10. The display device of claim 7, further comprising a plurality of the dummy switches.

11. The display device of claim 2, wherein the non-display area further comprises:

an initialization switch comprising an input terminal connected to an initialization data line configured to receive an initialization data signal from an external source;

an output terminal connected to one of the data lines; and a control terminal connected to an initialization switch control line configured to receive an initialization switch control signal from an external source.

12. The display device of claim 1, wherein the pixels comprise red pixels which display a red color, green pixels which display a green color, and blue pixels which display a blue color.

13. The display device of claim 12, wherein a connection line unit comprising the disconnection portion is connected to the green pixels.

14. The display device of claim 12, wherein the test data line comprises:

a red test data line connected to the red pixels;

a green test data line connected to the green pixels; and a blue test data line connected to the blue pixels.

15. The display device of claim 1, further comprising a plurality of the dummy line units, wherein the non-display area is divided into a plurality of sections and one of the dummy line units is formed in each of the sections.

16. The display device of claim 1, wherein the dummy line unit is formed along all edges of the non-display area.

* * * * *